US005497172A

United States Patent [19]

Doherty et al.

[11] Patent Number: 5,497,172

[45] Date of Patent: Mar. 5, 1996

[54] PULSE WIDTH MODULATION FOR SPATIAL LIGHT MODULATOR WITH SPLIT RESET ADDRESSING

[75] Inventors: Donald B. Doherty, Richardson; Robert J. Gove, Plano; Mark L. Burton, Dallas; Rodney D. Miller, Frisco, all of Tex.

[73] Assignee: Texas Instruments Incorporated, Dallas, Tex.

[21] Appl. No.: 259,402

[22] Filed: Jun. 13, 1994

[51] Int. Cl.[6] ..... G09G 3/34

[52] U.S. Cl. ..... 345/85; 345/108

[58] Field of Search ..... 345/89, 108, 85, 345/185; 359/54–58

[56] References Cited

U.S. PATENT DOCUMENTS

| | | | |
|---|---|---|---|
| 5,079,544 | 1/1992 | Demond et al. . | |
| 5,185,602 | 2/1993 | Bassetti, Jr. et al. | 345/89 |
| 5,245,328 | 9/1993 | Garrett | 345/89 |
| 5,280,277 | 1/1994 | Hornbeck | 345/108 |
| 5,313,224 | 5/1994 | Singhal et al. | 345/89 |

*Primary Examiner*—Ulysses Weldon

*Attorney, Agent, or Firm*—Julie L. Reed; Richard L. Donaldson; William E. Hiller

[57] ABSTRACT

A method of implementing pulse-width modulated image display systems (10, 20) with a spatial light modulator (SLM) (15) configured for split-reset addressing. Display frame periods are divided into time slices. Each frame of data is divided into bit-planes, each bit-plane having one bit of data for each pixel element and representing a bit weight of the intensity value to be displayed by that pixel element. Each bit-plane has a display time corresponding to a number of time slices, with bit-planes of higher bit weights being displayed for more time slices. The bit-planes are further formatted into reset groups, each reset group corresponding to a reset group of the SLM (15). The display times for reset groups of more significant bits are segmented so that the data can be displayed in segments rather than for a continuous time. During loading, segments of corresponding bit-planes are temporally aligned from one reset group to the next. The display times for less significant bits are not segmented but are temporally aligned to the extent possible without loading conflicts.

13 Claims, 3 Drawing Sheets

PULSE WIDTH MODULATION FOR SPATIAL LIGHT MODULATOR WITH SPLIT RESET ADDRESSING

TECHNICAL FIELD OF THE INVENTION

This invention relates to spatial light modulators used for image display systems, and more particularly to loading spatial light modulators with image data.

BACKGROUND OF THE INVENTION

Video display systems based on spatial light modulators (SLMs) are increasingly being used as an alternative to display systems using cathode ray tubes (CRTs). SLM systems provide high resolution displays without the bulk and power consumption of CRT systems.

Digital micro-mirror devices (DMDs) are a type of SLM, and may be used for either direct-view or projection display applications. A DMD has an array of micromechanical pixel elements, each having a tiny mirror that is individually addressable by an electronic signal. Depending on the state of its addressing signal, each mirror element tilts so that it either does or does not reflect light to the image plane. Other SLMs operate on similar principles, with an array of pixel elements that may emit or reflect light simultaneously with other pixel elements, such that a complete image is generated by addressing pixel elements rather than by scanning a screen. Another example of an SLM is a liquid crystal display (LCD) having individually driven pixel elements. Typically, displaying each frame of pixel data is accomplished by loading memory cells so that pixel elements can be simultaneously addressed.

To achieve intermediate levels of illumination, between white (on) and black (off), pulse-width modulation (PWM) techniques are used. The basic PWM scheme involves first determining the rate at which images are to be presented to the viewer. This establishes a frame rate and a corresponding frame period. For example, in a standard television system, images are transmitted at 30 frames per second, and each frame lasts for approximately 33.3 milliseconds. Then, the intensity resolution for each pixel element is established. In a simple example, and assuming n bits of resolution, the frame time is divided into $2^n-1$ equal time slices. For a 33.3 millisecond frame period and n-bit intensity values, the time slice is $33.3/2^n-1$ milliseconds.

Having established these times, for each pixel of each frame, pixel intensities are quantized, such that black is 0 time slices, the intensity level represented by the LSB is 1 time slice, and maximum brightness is $2^n-1$ time slices. Each pixel's quantized intensity determines its on-time during a frame period. Thus, during a frame period, each pixel with a quantized value of more than 0 is on for the number of time slices that correspond to its intensity. The viewer's eye integrates the pixel brightness so that the image appears the same as if it were generated with analog levels of light.

For addressing SLMs, PWM calls for the data to be formatted into "bit-planes", each bit-plane corresponding to a bit weight of the intensity value. Thus, if intensity is represented by an n-bit value, each frame of data has n bit-planes. Each bit-plane has a 0 or 1 value for each pixel element. In the simple PWM example described in the preceding paragraphs, during a frame, each bit-plane is separately loaded and the pixel elements addressed according to their associated bit-plane values. For example, the bit-plane representing the LSBs of each pixel is displayed for 1 time slice, whereas the bit-plane representing the MSBs is displayed for 2n/2 time slices. Because a time slice is only 33.3/255 milliseconds, the SLM must be capable of loading the LSB bit-plane within that time. The time for loading the LSB bit-plane is the "peak data rate".

A high peak data rate puts high throughput demands on the design of SLMs. To minimize the peak data rate, modifications to the above-described loading scheme have been devised. These loading schemes are acceptable only to the extent that they minimize visual artifacts in the displayed image.

One such modification uses a specially configured SLM, whose pixel elements are grouped into reset groups that are separately loaded and addressed. This reduces the amount of data to be loaded during any one time, and permits the LSB data for each reset group to be displayed at a different time during the frame period. This configuration is described in U.S. patent application Ser. No. 08/300,356, assigned to Texas Instruments Incorporated.

SUMMARY OF THE INVENTION

One aspect of the invention is a method of pulse-width modulating frames of data used by a spatial light modulator having individually addressable pixel elements. The display period for each frame of data is divided into a number of time slices. Each frame of data is formatted into bit-planes, with each bit-plane having one bit of data for each pixel element and representing a bit-weight of the intensity value to be displayed by that pixel element. Each bit-plane has a display time corresponding to a number of time slices. The bit-planes are then sub-formatted into reset groups, each reset group having data for a group of pixel elements to be addressed at a different time from other pixel elements. The display times of reset groups from bit-planes of one or more of the more significant bit weights are segmented into two or more segments, which permits those display times to be distributed throughout the frame period. The loading of memory cells associated with the pixel elements is then performed in three phases. First, front-frame loading loads about half of the segments, such that, for all reset groups, segments having the same bit weight are loaded at substantially the same time. Then, mid-frame loading loads the reset groups of bit-planes of one or more of the less significant bits. Finally, end-frame loading loads the remaining segments, such that for all reset groups, segments having the same bit-weight are loaded at substantially the same time.

A technical advantage of the invention is that it successfully implements data loading for split reset configurations. It provides good picture quality, both when the image is in motion and when it is still, by combining features of different data loading methods. The method does not require increased bandwidth or result in lower light efficiency, as compared to other split reset addressing methods.

DETAILED DESCRIPTION OF THE INVENTION

Overview of SLM Display Systems Using PWM

A comprehensive description of a DMD-based digital display system is set out in U.S. Pat. No. 5,079,544, entitled "Standard Independent Digitized Video System", and in U.S. patent application Ser. No. 08/147,249, entitled "Digital Television System", and in U.S. patent application Ser. No. 08/146,385, entitled "DMD Display System". Each of these patents and patent applications is assigned to Texas Instruments Incorporated, and each is incorporated by reference herein. An overview of such systems is discussed below in connection with FIGS. 1 and 2.

Figure 1:
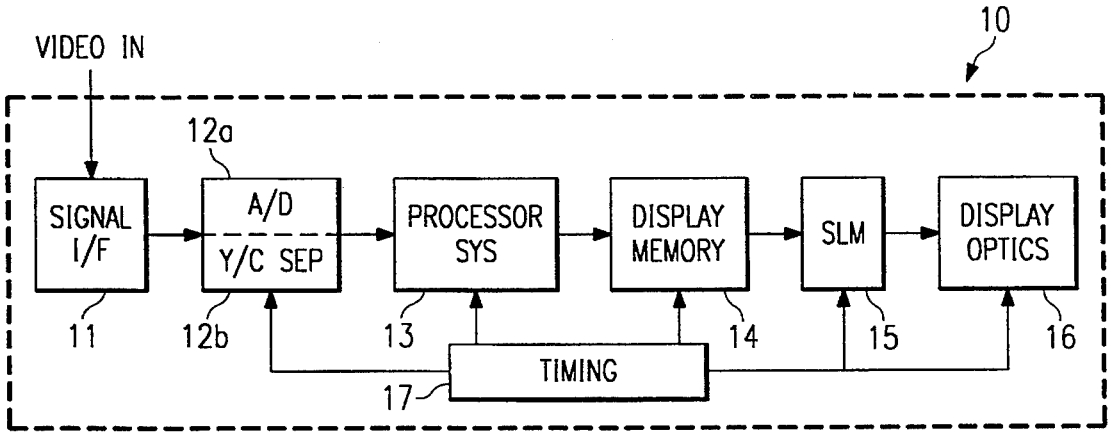
FIGS. 1 and 2 are block diagrams of image display systems, each having an SLM that is addressed with a split-reset PWM data loading method in accordance with the invention.
Figure 2:
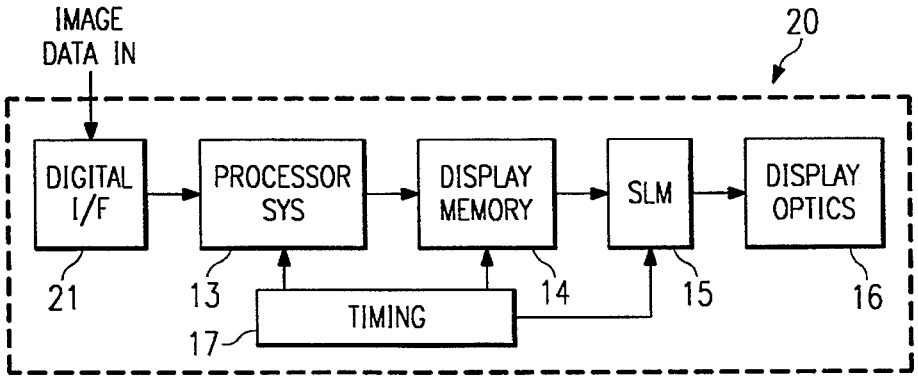

FIG. 1 is a block diagram of a projection display system 10, which uses an SLM 15 to generate real-time images from a analog video signal, such as a broadcast television signal. FIG. 2 is a block diagram of a similar system 20, in which the input signal already represents digital data. In both FIGS. 1 and 2, only those components significant to main-screen pixel data processing are shown. Other components, such as might be used for processing synchronization and audio signals or secondary screen features, such as closed captioning, are not shown.

Signal interface unit 11 receives an analog video signal and separates video, synchronization, and audio signals. It delivers the video signal to A/D converter 12*a* and Y/C separator 12*b*, which convert the data into pixel-data samples and which separate the luminance ("Y") data from the chrominance ("C") data, respectively. In FIG. 1, the signal is converted to digital data before Y/C separation, but in other embodiments, Y/C separation could be performed before A/D conversion, using analog filters.

Processor system 13 prepares the data for display, by performing various pixel data processing tasks. Processor system 13 includes whatever processing memory is useful for such tasks, such as field and line buffers. The tasks performed by processor system 13 may include linearization (to compensate for gamma correction), colorspace conversion, and line generation. The order in which these tasks are performed may vary.

Display memory 14 receives processed pixel data from processor system 13. It formats the data, on input or on output, into "bit-plane" format, and delivers the bit-planes to SLM 15 one at a time. The bit-plane format permits each pixel element of SLM 15 to be turned on or off in response to the value of 1 bit of data at a time. In a typical display system 10, display memory 14 is a "double buffer" memory, which means that it has a capacity for at least two display frames. The buffer for one display frame can be read out to SLM 15 while the buffer for another display frame is being written. The two buffers are controlled in a "ping-pong" manner so that data is continuously available to SLM 15.

As discussed in the Background, the data from display memory is delivered in bit-planes to SLM 15. Although this description is in terms of a DMD-type of SLM 15, other types of SLMs could be substituted into display system 10 and used for the invention described herein. For example, SLM 15 could be an LCD-type SLM. Details of a suitable SLM 15 are set out in U.S. Pat. No. 4,956,619, entitled "Spatial Light Modulator", which is assigned to Texas Instruments Incorporated, and incorporated by reference herein. Essentially, DMD 15 uses the data from display memory 14 to address its pixel elements. The "on" or "off" state of each pixel element in the array of DMD 15 forms an image.

U.S. Pat. No. 5,278,652, entitled "DMD Architecture and Timing for Use in a Pulse-Width Modulated Display System", describes a method of formatting video data for use with a DMD-based display system and a method of addressing them for PWM displays. This patent application is assigned to Texas Instruments Incorporated, and is incorporated herein by reference. Some of the techniques discussed therein include clearing blocks of pixel elements, using extra "off" times to load data, and of breaking up the time in which the more significant bits are displayed into smaller segments. These techniques could be used for any SLM using PWM.

Display optics unit 16 has optical components for receiving the image from SLM 15 and for illuminating an image plane such as a display screen. For color displays, the bit-planes for each color could be sequenced and synchronized to a color wheel that is part of display optics unit 16. Or, the data for different colors could be concurrently displayed on three SLMs and combined by display optics unit 16. Master timing unit 17 provides various system control functions.

Split Reset Addressing

Figure 3:
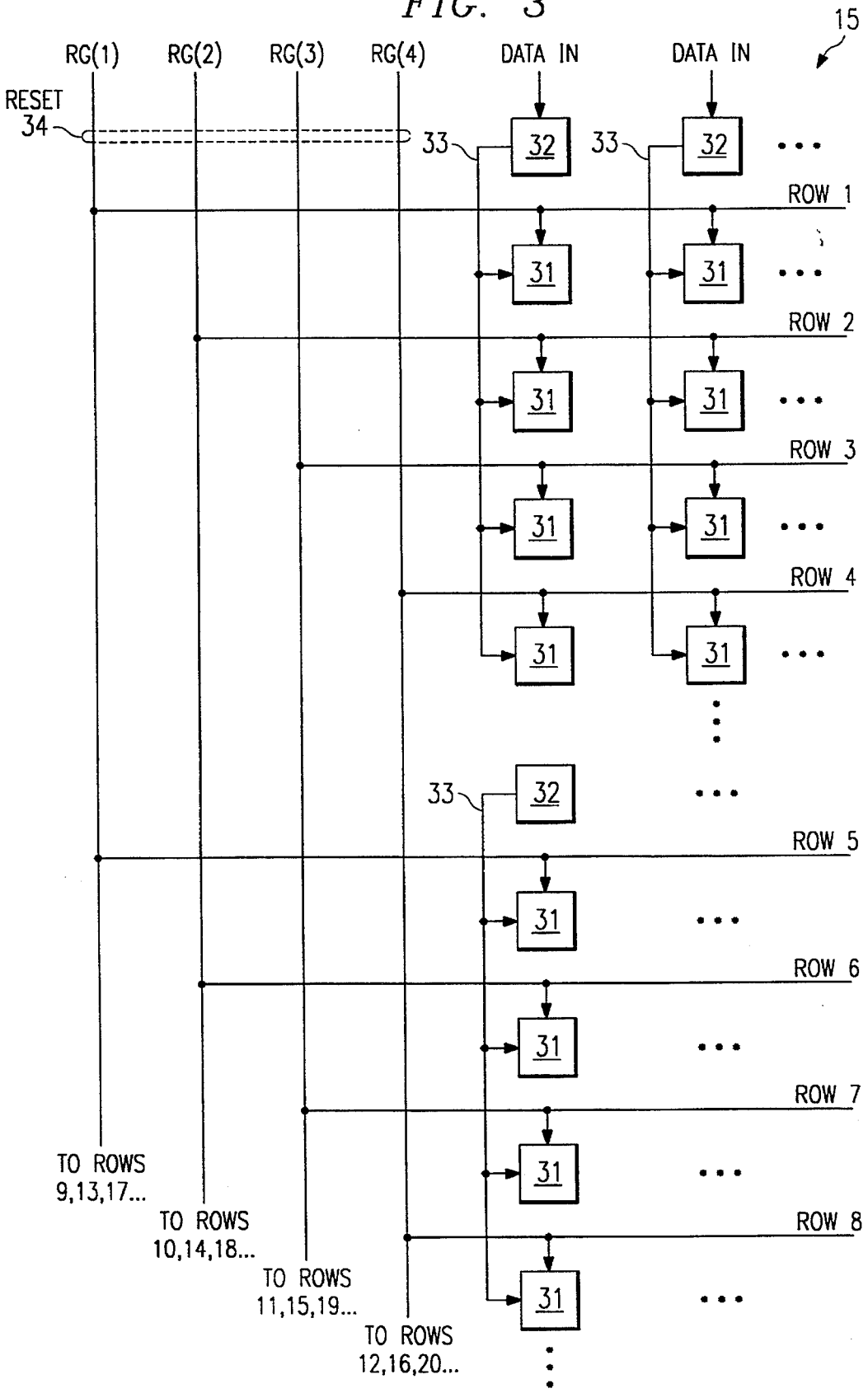
FIG. 3 illustrates the SLM of FIGS. 1 and 2, configured for split-reset addressing.

FIG. 3 illustrates the pixel element array of SLM 15, configured for split-reset addressing. Only a small number of pixel elements 31 and their related memory cells 32 are explicitly shown, but as indicated, SLM 15 has additional rows and columns of pixel elements 31 and memory cells 32. A typical SLM 15 has hundreds or thousands of such pixel elements 31.

In the example of FIG. 3, sets of four pixel elements 3t share a memory cell 32. As explained below, this divides SLM 15 into four reset groups of pixel elements 31. The data for these reset groups is formatted into reset group data. Thus, where p is the number of pixels and q is the number of reset groups, a bit-plane having p number of bits is formatted into a reset group having p/q bits of data. The reset groups are divided "horizontally" in the sense that every fourth line of pixel elements 31 belongs to a different reset group.

U.S. patent application Ser. No. 08/300,356, entitled "Pixel Control Circuitry for Spatial Light Modulator", assigned to Texas Instruments Incorporated and incorporated by reference herein, describes split-reset data loading and addressing for a DMD. These concepts are applicable to SLMs in general.

FIG. 3 illustrates how a single memory cell 32 serves multiple pixel elements 31. Pixel elements 31 are operated in a bistable mode. The switching of their states from on to off is controlled by loading their memory cells 32 with a bit of data and applying a voltage indicated by that bit to address electrodes connected to the pixel elements via address lines 33. Then, the state of the pixel element 31 is switched, in accordance with the voltage applied to each, by means of a reset signal via reset lines 34. In other words, for each set of four pixel elements 31, either 1 or a 0 data value is delivered to their memory cell 32, and applied to these pixel elements 31 as a "+" or "−" voltage. Signals on the reset lines 34 determine which pixel element 31 in that set will change state.

One aspect of split-reset addressing is that only a subset of the entire SLM array is loaded at one time. In other words, instead of loading an entire bit-plane of data at once, the loading for reset groups of that bit-plane's data occurs at different times within the frame period. A reset signal determines which pixel element 31 associated with a memory cell 32 will be turned on or off.

The pixel elements 31 are grouped into sets of four pixel elements 31, each from a different reset group. Each set is in communication with a memory cell 32. In the horizontal split reset example, pixel elements 31 from each of the first four lines, each belonging to a different reset group, share the same memory cell 32. The pixel elements 31 from each of the next four lines would also share memory cells 32. The number of pixel elements 31 associated with a single memory cell 32 is referred to as the "fanout" of that memory cell 32. The fanout could be some other number. A greater fanout results in the use of fewer memory cells 32 and a reduced amount of data loading within each reset period, but requires more resets per frame.

In each set of four pixel elements 31, four reset lines 34 control the times when the pixel elements 31 change state. Each pixel element 31 in this set is connected to a different reset line 34. This permits each pixel element 31 in a set to change its state at a different time from that of the other pixel elements 31 in that set. It also permits an entire reset group to be controlled by a common signal on its reset lines 34.

Once all memory cells 32 for the pixel elements 31 of a particular reset group have been loaded, the reset lines 34 provide a reset signal to cause the states of those pixel elements 31 to change in accordance with the data in their associated memory cells 32. In other words, the pixel elements 31 retain their current state as the data supplied to them changes, and until receiving a reset signal.

PWM addressing sequences for split-reset SLM's are devised in accordance with various heuristic rules. One rule is that the data for no more than one reset group can be loaded at the same time. In other words, the loading of different reset groups must not conflict. Other "optional" rules are described in U.S. patent application Ser. No. 08/300,356, assigned to Texas Instruments Incorporated and incorporated by reference herein.

One aspect of the invention is the recognition that when split-reset loading is used for PWM, certain loading sequences cause visual artifacts, which can be avoided by modifications to the loading sequence. Moreover, certain artifacts are related to the type of image being displayed.

A first type of artifact occurs during still images and is seen as a contouring of particular levels in the image as a function of rapid eye motion, motion of the SLM, or interruptions such as caused by hand waving in front of the face. This artifact is avoided by dividing the display times of the bit-planes of the more significant bits into smaller segments. For example, for a frame period having 255 time slices and 8-bit pixel values, the MSB, bit 7, is represented by an on or off time of 128 time slices. The MSB bit-plane data for each reset group is loaded at different times but displayed for this 128 time-slice duration. These 128 time slices can be divided into segments. Typically, the segments are of equal duration, but this is not necessary. The loading for the segments is distributed throughout the frame period. This loading method is referred to as an "interleaving method". The bit-planes selected for segmentation could be any one or more of the bit-planes other than that of the LSB.

A second type of artifact occurs during motion images, where the viewer tracks the object undergoing motion. This artifact is avoided by localizing as much illumination as possible into an instantaneous burst. Subject to the rule that no two reset groups can be loaded at once, data for the same bit-weights of all reset groups are loaded near together in time. This addressing method is referred to as a "alignment method".

Figure 4:
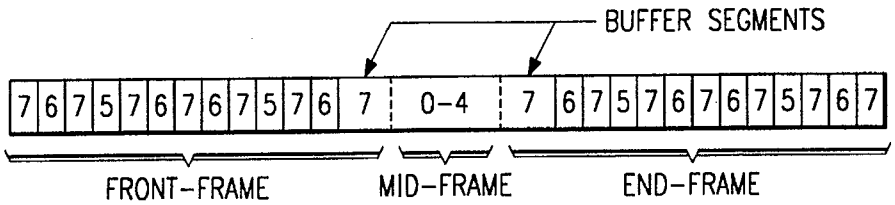
FIG. 4 illustrates an example of a data loading sequence in accordance with the invention.
Figure 5:
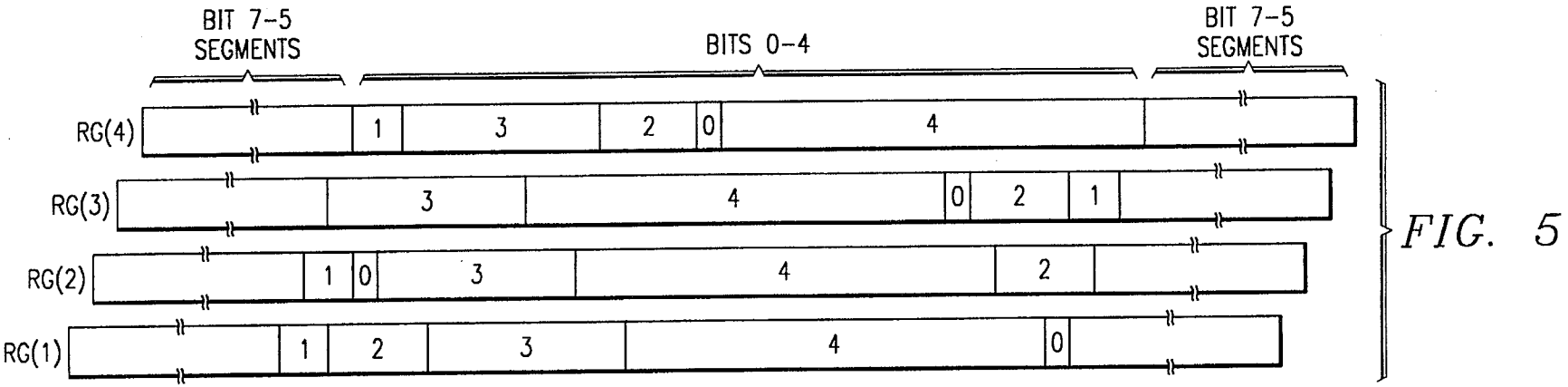
FIG. 5 further illustrates the loading of the less significant bits of the sequence of FIG. 4.
Figure 6:
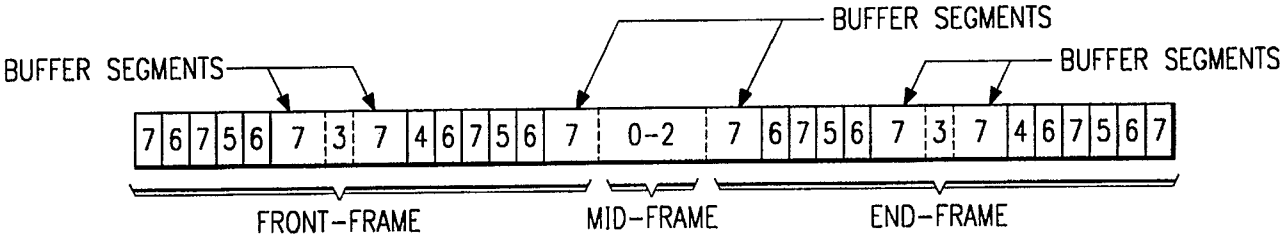
FIG. 6 illustrates another example of a data loading sequence in accordance with the invention.

FIGS. 4–6 illustrate how aspects of both interleaving and aligning can be combined to result in a data loading sequence that minimizes visual artifacts for both still and motion images. In each of the following methods, 8-bit pixel values are assumed, so as to provide 256 levels of brightness resolution. Also, for purposes of simplicity, only 4 reset groups are assumed. However, the same concepts are applicable to pixel values with a different resolution, as well as to SLMs having fewer or more reset groups.

Temporally Correlated MSB Addressing

FIGS. 4 and 5 illustrate one example of a method of loading data formatted for PWM on a split-reset SLM. This method combines features of both interleaving and aligning. Bit-plane segments (for bits 5–7) or unsegmented bit-planes (for bits 0–4) are loaded in the basic sequence illustrated in FIG. 4. Each reset group is loaded in this same sequence, with the exception being the unsegmented bit-planes (bits 0–4), whose loading sequence is illustrated in FIG. 5. FIGS. 4 and 5 are intended to illustrate loading sequences as opposed to display timing—an example of both loading sequence and display timing is illustrated in Appendix A.

Consistent with the interleaving method, the more significant bits (bits 5–7) are split into segments, which are distributed throughout the frame period. However, consistent with the alignment method, the distribution of the more significant bit segments is time-ordered rather than random. The time-ordering calls for loading the more significant bits in a regular sequence such that segments of the same bit weight are displayed at nearly the same time for all reset groups. The bit-planes for the less significant bits are loaded during the middle of the frame period.

More specifically, the more significant bits, bits 7–5, are broken into segments. Bit 7 has 14 segments, bit 6 has 8, and bit 5 has 4. Each segment is 16 time slices long, except for two segments of bit 7, one immediately before and one immediately after the less significant bits. As explained below, these two segments may be used as "buffer segments" when there is a large number of reset groups. If the number of reset groups is small, the buffer segments may not be required and all segments of a bit-plane could be a constant size. The less significant bits, bits 4–0, are not broken into segments. Bit 4 has 16 LSB periods, bit 3 has 8, bit 2 has 4, bit 1 has 2, and bit 0 has 1.

The loading of each frame of data has three phases—front-frame loading, mid-frame loading, and end-frame loading. During front-frame loading, the segments for bits 5–7 are loaded in a regular sequence. By "regular" is meant that each reset group is loaded in the same sequence. During mid-frame loading, bits 0–4 are loaded. The loading sequence of bits 0–4 varies among the reset groups so as to avoid conflicts. During end-frame loading, all segments of bits 5–7 remaining in the frame are loaded in a regular pattern.

During loading, for each next reset group, the loading of corresponding segments or unsegmented bit-planes is staggered by at least one time slice. Although the result is a slight "skew" from each reset-group to the next, the staggering satisfies the rule that no two reset groups can be loaded at the same time. Typically, it is desirable to minimize the skew to only one time slice, but as explained below, avoiding conflicts when loading less significant bits may require a greater skew.

FIG. 5 illustrates an example of the mid-frame loading of the less significant bits, which varies among reset groups. In the example of FIG. 5, there are four reset groups, designated as RG(1), RG(2), RG(3) and RG(4). In general, the smaller the number of reset groups, the simpler it is to avoid loading conflicts.

FIGS. 4 and 5 also illustrate the relationship between the number of loads per frame and the number of time slices per frame. The number of loads per frame cannot exceed the number of time slices of a frame. The number of loads per frame is the number of segments and unsegmented bit-planes, times the number of reset groups. In the example of FIGS. 4 and 5, for each reset group, there are 14+8+4 (26) segments of bits 7–5 and 5 bit-planes for bits 4–0. Thus, there are 26+5=31 loads per frame per reset group. With 4 reset groups, the number of loads per frame is 31*4=128. This is an acceptable segmentation scheme because 128 is less than 255, the number of time slices.

Appendix A illustrates how the loading sequence of FIGS. 4 and 5 may be adapted for SLMs having a larger number of reset groups. As the number of reset groups increases, the number of time slices required to load data per frame increases. For example, an SLM having 16 reset groups and following the segmentation scheme of FIGS. 4 and 5, requires 31*16=496 loads per frame. This may be accomplished by dividing the frame into 510 time slices instead of 255. Each segment of bits 7–5 and each bit-plane for bits 4–0 is displayed for twice as many time slices. For example, the LSB bit-plane is displayed for two time slices rather than one.

Also, as illustrated by Appendix A, as the number of reset groups increases, the number of loads for the less significant bits may increase past the time slices that they are allocated. For example, an SLM that has 16 reset groups and follows the sequence of FIG. 4, requires 5*16= 80 loads to load bits 4–0. However, where there are 510 time slices per frame, the mid-frame loading of bits 4–0 is allocated a total of only 62 time slices. To accommodate the increased number of mid-frame loads, the staggering of the reset group load times is increased. During mid-frame loading, the loading for the first bit-plane is delayed by 3 time slices from one reset group to the next. As a result, the size of the "buffer segment" immediately preceding this bit-plane "grows" by 3 time slices from one reset group to the next. To re-align the reset groups after mid-frame loading, the "buffer segment" immediately following the last mid-frame bit-plane "shrinks" by 3 time slices for each next reset group.

FIG. 6 illustrates another method of split-reset PWM addressing. Like FIGS. 4 and 5, FIG. 6 illustrates a sequence that combines features of both interleaving and aligning. However, in the method of FIG. 6, bits 3 and 4 as well as bits 7–5, are segmented. Thus, bits 3–7 are treated as the more significant bits.

The segments of bits 3–7 are loaded in a regular sequence such that segments of the same bit weight are loaded at nearly the same time for all reset groups. The bit-planes for bits 2–0 are loaded at the middle of the frame period. The rule that no two reset groups can be loaded at once is satisfied by staggering the loading at least one time slice.

As in the method of FIGS. 4 and 5, the segments immediately before and after the mid-frame loading of the less significant bits may be used as "buffer segments" when the number of reset groups is too large to avoid conflicts without them. However, for the same reason, the segments immediately before and after the bit 3 segments may also be used as "buffer segments". As explained above, this means that the size of these segments may grow and shrink from reset group to reset group, which permits loading of the less significant bits to be staggered an extra amount.

The method of FIGS. 4 and 5 and the method of FIG. 6 have several common features. Bit-planes of the more significant bits are segmented. To the extent possible, bit segments are temporally aligned. However, as the bit-weight of the segment decreases and the number of reset groups increases, it becomes more difficult to align the data and still avoid loading conflicts. Thus, the bit-planes of less significant bits are concentrated in mid-frame and are "scrambled" rather than temporally aligned. Also, "buffer segments" are used to permit increased staggering so that number of reset groups does not prohibit some degree of alignment of the mid-frame bits or segments of bit-planes of less significant bits.

Ordering of Reset Groups

Another aspect of the invention is that the order in which reset groups are addressed has an effect on whether artifacts occur. For example, in a horizontal split reset configuration, where n reset groups are arranged as every nth line of a display, certain reset group patterns can reduce the perception of strobing. In particular, a "by 3" pattern is desirable.

For an SLM having 16 horizontal reset groups, such that every 16th line is in the same reset group, an example of a "by 3" ordering pattern is as follows:

1 4 7 10 13 0 3 6 9 12 15 2 5 8 11 14.

In other words, all rows of the 1st reset group are loaded, then all rows of the 4th reset group, in a series of every third reset group. Then, beginning with the 0th reset group, every third reset group is loaded. Finally, a third series of every third reset group, beginning with the 2d reset group, is loaded. In general, the reset groups are loaded in n series of every nth reset group, and the sequence can be begin with any reset group.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 7 | | | | | | | | | | | | | | | |
| 2 | | 7 | | | | | | | | | | | | | | |
| 3 | | | 7 | | | | | | | | | | | | | |
| 4 | | | | 7 | | | | | | | | | | | | |
| 5 | | | | | 7 | | | | | | | | | | | |
| 6 | | | | | | 7 | | | | | | | | | | |
| 7 | | | | | | | 7 | | | | | | | | | |
| 8 | | | | | | | | 7 | | | | | | | | |
| 9 | | | | | | | | | 7 | | | | | | | |
| 10 | | | | | | | | | | 7 | | | | | | |
| 11 | | | | | | | | | | | 7 | | | | | |
| 12 | | | | | | | | | | | | 7 | | | | |
| 13 | | | | | | | | | | | | | 7 | | | |
| 14 | | | | | | | | | | | | | | 7 | | |
| 15 | | | | | | | | | | | | | | | 7 | |
| 16 | 7 | | | | | | | | | | | | | | | 7 |
| 17 | 6 | 7 | | | | | | | | | | | | | | |
| 18 | | 6 | 7 | | | | | | | | | | | | | |
| 19 | | | 6 | 7 | | | | | | | | | | | | |
| 20 | | | | 6 | 7 | | | | | | | | | | | |
| 21 | | | | | 6 | 7 | | | | | | | | | | |
| 22 | | | | | | 6 | 7 | | | | | | | | | |
| 23 | | | | | | | 6 | 7 | | | | | | | | |
| 24 | | | | | | | | 6 | 7 | | | | | | | |
| 25 | | | | | | | | | 6 | 7 | | | | | | |
| 26 | | | | | | | | | | 6 | 7 | | | | | |
| 27 | | | | | | | | | | | 6 | 7 | | | | |
| 28 | | | | | | | | | | | | 6 | 7 | | | |
| 29 | | | | | | | | | | | | | 6 | 7 | | |
| 30 | | | | | | | | | | | | | | 6 | 7 | |
| 31 | | | | | | | | | | | | | | | 6 | 7 |
| 32 | 6 | | | | | | | | | | | | | | | 6 |
| 33 | 7 | 6 | | | | | | | | | | | | | | |
| 34 | | 7 | 6 | | | | | | | | | | | | | |
| 35 | | | 7 | 6 | | | | | | | | | | | | |
| 36 | | | | 7 | 6 | | | | | | | | | | | |
| 37 | | | | | 7 | 6 | | | | | | | | | | |
| 38 | | | | | | 7 | 6 | | | | | | | | | |
| 39 | | | | | | | 7 | 6 | | | | | | | | |
| 40 | | | | | | | | 7 | 6 | | | | | | | |
| 41 | | | | | | | | | 7 | 6 | | | | | | |
| 42 | | | | | | | | | | 7 | 6 | | | | | |
| 43 | | | | | | | | | | | 7 | 6 | | | | |
| 44 | | | | | | | | | | | | 7 | 6 | | | |
| 45 | | | | | | | | | | | | | 7 | 6 | | |
| 46 | | | | | | | | | | | | | | 7 | 6 | |
| 47 | | | | | | | | | | | | | | | 7 | 6 |
| 48 | 7 | | | | | | | | | | | | | | | 7 |
| 49 | 5 | 7 | | | | | | | | | | | | | | |
| 50 | | 5 | 7 | | | | | | | | | | | | | |
| 51 | | | 5 | 7 | | | | | | | | | | | | |
| 52 | | | | 5 | 7 | | | | | | | | | | | |
| 53 | | | | | 5 | 7 | | | | | | | | | | |
| 54 | | | | | | 5 | 7 | | | | | | | | | |
| 55 | | | | | | | 5 | 7 | | | | | | | | |
| 56 | | | | | | | | 5 | 7 | | | | | | | |
| 57 | | | | | | | | | 5 | 7 | | | | | | |
| 58 | | | | | | | | | | 5 | 7 | | | | | |
| 59 | | | | | | | | | | | 5 | 7 | | | | |
| 60 | | | | | | | | | | | | 5 | 7 | | | |
| 61 | | | | | | | | | | | | | 5 | 7 | | |
| 62 | | | | | | | | | | | | | | 5 | 7 | |
| 63 | | | | | | | | | | | | | | | 5 | 7 |
| 64 | 5 | | | | | | | | | | | | | | | 5 |
| 65 | 7 | 5 | | | | | | | | | | | | | | |
| 66 | | 7 | 5 | | | | | | | | | | | | | |
| 67 | | | 7 | 5 | | | | | | | | | | | | |
| 68 | | | | 7 | 5 | | | | | | | | | | | |
| 69 | | | | | 7 | 5 | | | | | | | | | | |
| 70 | | | | | | 7 | 5 | | | | | | | | | |
| 71 | | | | | | | 7 | 5 | | | | | | | | |
| 72 | | | | | | | | 7 | 5 | | | | | | | |
| 73 | | | | | | | | | 7 | 5 | | | | | | |
| 74 | | | | | | | | | | 7 | 5 | | | | | |

-continued

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 75 | | | | | | | | | | | 7 | 5 | | | | |
| 76 | | | | | | | | | | | | 7 | 5 | | | |
| 77 | | | | | | | | | | | | | 7 | 5 | | |
| 78 | | | | | | | | | | | | | | 7 | 5 | |
| 79 | | | | | | | | | | | | | | | 7 | 5 |
| 80 | 7 | | | | | | | | | | | | | | | 7 |
| 81 | 6 | 7 | | | | | | | | | | | | | | |
| 82 | | 6 | 7 | | | | | | | | | | | | | |
| 83 | | | 6 | 7 | | | | | | | | | | | | |
| 84 | | | | 6 | 7 | | | | | | | | | | | |
| 85 | | | | | 6 | 7 | | | | | | | | | | |
| 86 | | | | | | 6 | 7 | | | | | | | | | |
| 87 | | | | | | | 6 | 7 | | | | | | | | |
| 88 | | | | | | | | 6 | 7 | | | | | | | |
| 89 | | | | | | | | | 6 | 7 | | | | | | |
| 90 | | | | | | | | | | 6 | 7 | | | | | |
| 91 | | | | | | | | | | | 6 | 7 | | | | |
| 92 | | | | | | | | | | | | 6 | 7 | | | |
| 93 | | | | | | | | | | | | | 6 | 7 | | |
| 94 | | | | | | | | | | | | | | 6 | 7 | |
| 95 | | | | | | | | | | | | | | | 6 | 7 |
| 96 | 6 | | | | | | | | | | | | | | | 6 |
| 97 | 7 | 6 | | | | | | | | | | | | | | |
| 98 | | 7 | 6 | | | | | | | | | | | | | |
| 99 | | | 7 | 6 | | | | | | | | | | | | |
| 100 | | | | 7 | 6 | | | | | | | | | | | |
| 101 | | | | | 7 | 6 | | | | | | | | | | |
| 102 | | | | | | 7 | 6 | | | | | | | | | |
| 103 | | | | | | | 7 | 6 | | | | | | | | |
| 104 | | | | | | | | 7 | 6 | | | | | | | |
| 105 | | | | | | | | | 7 | 6 | | | | | | |
| 106 | | | | | | | | | | 7 | 6 | | | | | |
| 107 | | | | | | | | | | | 7 | 6 | | | | |
| 108 | | | | | | | | | | | | 7 | 6 | | | |
| 109 | | | | | | | | | | | | | 7 | 6 | | |
| 110 | | | | | | | | | | | | | | 7 | 6 | |
| 111 | | | | | | | | | | | | | | | 7 | 6 |
| 112 | 7 | | | | | | | | | | | | | | | 7 |
| 113 | 6 | 7 | | | | | | | | | | | | | | |
| 114 | | 6 | 7 | | | | | | | | | | | | | |
| 115 | | | 6 | 7 | | | | | | | | | | | | |
| 116 | | | | 6 | 7 | | | | | | | | | | | |
| 117 | | | | | 6 | 7 | | | | | | | | | | |
| 118 | | | | | | 6 | 7 | | | | | | | | | |
| 119 | | | | | | | 6 | 7 | | | | | | | | |
| 120 | | | | | | | | 6 | 7 | | | | | | | |
| 121 | | | | | | | | | 6 | 7 | | | | | | |
| 122 | | | | | | | | | | 6 | 7 | | | | | |
| 123 | | | | | | | | | | | 6 | 7 | | | | |
| 124 | | | | | | | | | | | | 6 | 7 | | | |
| 125 | | | | | | | | | | | | | 6 | 7 | | |
| 126 | | | | | | | | | | | | | | 6 | 7 | |
| 127 | | | | | | | | | | | | | | | 6 | 7 |
| 128 | 6 | | | | | | | | | | | | | | | 6 |
| 129 | 7 | 6 | | | | | | | | | | | | | | |
| 130 | | 7 | 6 | | | | | | | | | | | | | |
| 131 | | | 7 | 6 | | | | | | | | | | | | |
| 132 | | | | 7 | 6 | | | | | | | | | | | |
| 133 | | | | | 7 | 6 | | | | | | | | | | |
| 134 | | | | | | 7 | 6 | | | | | | | | | |
| 135 | | | | | | | 7 | 6 | | | | | | | | |
| 136 | | | | | | | | 7 | 6 | | | | | | | |
| 137 | | | | | | | | | 7 | 6 | | | | | | |
| 138 | | | | | | | | | | 7 | 6 | | | | | |
| 139 | | | | | | | | | | | 7 | 6 | | | | |
| 140 | | | | | | | | | | | | 7 | 6 | | | |
| 141 | | | | | | | | | | | | | 7 | 6 | | |
| 142 | | | | | | | | | | | | | | 7 | 6 | |
| 143 | | | | | | | | | | | | | | | 7 | 6 |
| 144 | 7 | | | | | | | | | | | | | | | 7 |
| 145 | 5 | 7 | | | | | | | | | | | | | | |
| 146 | | 5 | 7 | | | | | | | | | | | | | |
| 147 | | | 5 | 7 | | | | | | | | | | | | |
| 148 | | | | 5 | 7 | | | | | | | | | | | |

-continued

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 149 | 1 | 1 | 1 | 1 | 5 | 7 | 1 | 1 | 1 | 1 | 1 | 1 | 1 | 1 | 1 | 1 |
| 150 | 1 | 1 | 1 | 1 | 1 | 5 | 7 | 1 | 1 | 1 | 1 | 1 | 1 | 1 | 1 | 1 |
| 151 | 1 | 1 | 1 | 1 | 1 | 1 | 5 | 7 | 1 | 1 | 1 | 1 | 1 | 1 | 1 | 1 |
| 152 | 1 | 1 | 1 | 1 | 1 | 1 | 1 | 5 | 7 | 1 | 1 | 1 | 1 | 1 | 1 | 1 |
| 153 | 1 | 1 | 1 | 1 | 1 | 1 | 1 | 1 | 5 | 7 | 1 | 1 | 1 | 1 | 1 | 1 |
| 154 | 1 | 1 | 1 | 1 | 1 | 1 | 1 | 1 | 1 | 5 | 7 | 1 | 1 | 1 | 1 | 1 |
| 155 | 1 | 1 | 1 | 1 | 1 | 1 | 1 | 1 | 1 | 1 | 5 | 7 | 1 | 1 | 1 | 1 |
| 156 | 1 | 1 | 1 | 1 | 1 | 1 | 1 | 1 | 1 | 1 | 1 | 5 | 7 | 1 | 1 | 1 |
| 157 | 1 | 1 | 1 | 1 | 1 | 1 | 1 | 1 | 1 | 1 | 1 | 1 | 5 | 7 | 1 | 1 |
| 158 | 1 | 1 | 1 | 1 | 1 | 1 | 1 | 1 | 1 | 1 | 1 | 1 | 1 | 5 | 7 | 1 |
| 159 | 1 | 1 | 1 | 1 | 1 | 1 | 1 | 1 | 1 | 1 | 1 | 1 | 1 | 1 | 5 | 7 |
| 160 | 5 | 1 | 1 | 1 | 1 | 1 | 1 | 1 | 1 | 1 | 1 | 1 | 1 | 1 | 1 | 5 |
| 161 | 7 | 5 | 1 | 1 | 1 | 1 | 1 | 1 | 1 | 1 | 1 | 1 | 1 | 1 | 1 | 1 |
| 162 | 1 | 7 | 5 | 1 | 1 | 1 | 1 | 1 | 1 | 1 | 1 | 1 | 1 | 1 | 1 | 1 |
| 163 | 1 | 1 | 7 | 5 | 1 | 1 | 1 | 1 | 1 | 1 | 1 | 1 | 1 | 1 | 1 | 1 |
| 164 | 1 | 1 | 1 | 7 | 5 | 1 | 1 | 1 | 1 | 1 | 1 | 1 | 1 | 1 | 1 | 1 |
| 165 | 1 | 1 | 1 | 1 | 7 | 5 | 1 | 1 | 1 | 1 | 1 | 1 | 1 | 1 | 1 | 1 |
| 166 | 1 | 1 | 1 | 1 | 1 | 7 | 5 | 1 | 1 | 1 | 1 | 1 | 1 | 1 | 1 | 1 |
| 167 | 1 | 1 | 1 | 1 | 1 | 1 | 7 | 5 | 1 | 1 | 1 | 1 | 1 | 1 | 1 | 1 |
| 168 | 1 | 1 | 1 | 1 | 1 | 1 | 1 | 7 | 5 | 1 | 1 | 1 | 1 | 1 | 1 | 1 |
| 169 | 1 | 1 | 1 | 1 | 1 | 1 | 1 | 1 | 7 | 5 | 1 | 1 | 1 | 1 | 1 | 1 |
| 170 | 1 | 1 | 1 | 1 | 1 | 1 | 1 | 1 | 1 | 7 | 5 | 1 | 1 | 1 | 1 | 1 |
| 171 | 1 | 1 | 1 | 1 | 1 | 1 | 1 | 1 | 1 | 1 | 7 | 5 | 1 | 1 | 1 | 1 |
| 172 | 1 | 1 | 1 | 1 | 1 | 1 | 1 | 1 | 1 | 1 | 1 | 7 | 5 | 1 | 1 | 1 |
| 173 | 1 | 1 | 1 | 1 | 1 | 1 | 1 | 1 | 1 | 1 | 1 | 1 | 7 | 5 | 1 | 1 |
| 174 | 1 | 1 | 1 | 1 | 1 | 1 | 1 | 1 | 1 | 1 | 1 | 1 | 1 | 7 | 5 | 1 |
| 175 | 1 | 1 | 1 | 1 | 1 | 1 | 1 | 1 | 1 | 1 | 1 | 1 | 1 | 1 | 7 | 5 |
| 176 | 7 | 1 | 1 | 1 | 1 | 1 | 1 | 1 | 1 | 1 | 1 | 1 | 1 | 1 | 1 | 7 |
| 177 | 6 | 7 | 1 | 1 | 1 | 1 | 1 | 1 | 1 | 1 | 1 | 1 | 1 | 1 | 1 | 1 |
| 178 | 1 | 6 | 7 | 1 | 1 | 1 | 1 | 1 | 1 | 1 | 1 | 1 | 1 | 1 | 1 | 1 |
| 179 | 1 | 1 | 6 | 7 | 1 | 1 | 1 | 1 | 1 | 1 | 1 | 1 | 1 | 1 | 1 | 1 |
| 180 | 1 | 1 | 1 | 6 | 7 | 1 | 1 | 1 | 1 | 1 | 1 | 1 | 1 | 1 | 1 | 1 |
| 181 | 1 | 1 | 1 | 1 | 6 | 7 | 1 | 1 | 1 | 1 | 1 | 1 | 1 | 1 | 1 | 1 |
| 182 | 1 | 1 | 1 | 1 | 1 | 6 | 7 | 1 | 1 | 1 | 1 | 1 | 1 | 1 | 1 | 1 |
| 183 | 1 | 1 | 1 | 1 | 1 | 1 | 6 | 7 | 1 | 1 | 1 | 1 | 1 | 1 | 1 | 1 |
| 184 | 1 | 1 | 1 | 1 | 1 | 1 | 1 | 6 | 7 | 1 | 1 | 1 | 1 | 1 | 1 | 1 |
| 185 | 1 | 1 | 1 | 1 | 1 | 1 | 1 | 1 | 6 | 7 | 1 | 1 | 1 | 1 | 1 | 1 |
| 186 | 1 | 1 | 1 | 1 | 1 | 1 | 1 | 1 | 1 | 6 | 7 | 1 | 1 | 1 | 1 | 1 |
| 187 | 1 | 1 | 1 | 1 | 1 | 1 | 1 | 1 | 1 | 1 | 6 | 7 | 1 | 1 | 1 | 1 |
| 188 | 1 | 1 | 1 | 1 | 1 | 1 | 1 | 1 | 1 | 1 | 1 | 6 | 7 | 1 | 1 | 1 |
| 189 | 1 | 1 | 1 | 1 | 1 | 1 | 1 | 1 | 1 | 1 | 1 | 1 | 6 | 7 | 1 | 1 |
| 190 | 1 | 1 | 1 | 1 | 1 | 1 | 1 | 1 | 1 | 1 | 1 | 1 | 1 | 6 | 7 | 1 |
| 191 | 1 | 1 | 1 | 1 | 1 | 1 | 1 | 1 | 1 | 1 | 1 | 1 | 1 | 1 | 6 | 7 |
| 192 | 6 | 1 | 1 | 1 | 1 | 1 | 1 | 1 | 1 | 1 | 1 | 1 | 1 | 1 | 1 | 6 |
| 193 | 7 | 6 | 1 | 1 | 1 | 1 | 1 | 1 | 1 | 1 | 1 | 1 | 1 | 1 | 1 | 1 |
| 194 | 1 | 7 | 6 | 1 | 1 | 1 | 1 | 1 | 1 | 1 | 1 | 1 | 1 | 1 | 1 | 1 |
| 195 | 1 | 1 | 7 | 6 | 1 | 1 | 1 | 1 | 1 | 1 | 1 | 1 | 1 | 1 | 1 | 1 |
| 196 | 1 | 1 | 1 | 7 | 6 | 1 | 1 | 1 | 1 | 1 | 1 | 1 | 1 | 1 | 1 | 1 |
| 197 | 1 | 1 | 1 | 1 | 7 | 6 | 1 | 1 | 1 | 1 | 1 | 1 | 1 | 1 | 1 | 1 |
| 198 | 1 | 1 | 1 | 1 | 1 | 7 | 6 | 1 | 1 | 1 | 1 | 1 | 1 | 1 | 1 | 1 |
| 199 | 1 | 1 | 1 | 1 | 1 | 1 | 7 | 6 | 1 | 1 | 1 | 1 | 1 | 1 | 1 | 1 |
| 200 | 1 | 1 | 1 | 1 | 1 | 1 | 1 | 7 | 6 | 1 | 1 | 1 | 1 | 1 | 1 | 1 |
| 201 | 1 | 1 | 1 | 1 | 1 | 1 | 1 | 1 | 7 | 6 | 1 | 1 | 1 | 1 | 1 | 1 |
| 202 | 1 | 1 | 1 | 1 | 1 | 1 | 1 | 1 | 1 | 7 | 6 | 1 | 1 | 1 | 1 | 1 |
| 203 | 1 | 1 | 1 | 1 | 1 | 1 | 1 | 1 | 1 | 1 | 7 | 6 | 1 | 1 | 1 | 1 |
| 204 | 1 | 1 | 1 | 1 | 1 | 1 | 1 | 1 | 1 | 1 | 1 | 7 | 6 | 1 | 1 | 1 |
| 205 | 1 | 1 | 1 | 1 | 1 | 1 | 1 | 1 | 1 | 1 | 1 | 1 | 7 | 6 | 1 | 1 |
| 206 | 1 | 1 | 1 | 1 | 1 | 1 | 1 | 1 | 1 | 1 | 1 | 1 | 1 | 7 | 6 | 1 |
| 207 | 1 | 1 | 1 | 1 | 1 | 1 | 1 | 1 | 1 | 1 | 1 | 1 | 1 | 1 | 7 | 6 |
| 208 | 1 | 1 | 1 | 1 | 1 | 1 | 1 | 1 | 1 | 1 | 1 | 1 | 1 | 1 | 1 | 7 |
| 209 | 7 | 1 | 1 | 1 | 1 | 1 | 1 | 1 | 1 | 1 | 1 | 1 | 1 | 1 | 1 | 1 |
| 210 | 1 | 1 | 1 | 1 | 1 | 1 | 1 | 1 | 1 | 1 | 1 | 1 | 1 | 1 | 1 | 1 |
| 211 | 1 | 1 | 1 | 1 | 1 | 1 | 1 | 1 | 1 | 1 | 1 | 1 | 1 | 1 | 1 | 1 |
| 212 | 1 | 7 | 1 | 1 | 1 | 1 | 1 | 1 | 1 | 1 | 1 | 1 | 1 | 1 | 1 | 1 |
| 213 | 1 | 1 | 1 | 1 | 1 | 1 | 1 | 1 | 1 | 1 | 1 | 1 | 1 | 1 | 1 | 1 |
| 214 | 3 | 1 | 1 | 1 | 1 | 1 | 1 | 1 | 1 | 1 | 1 | 1 | 1 | 1 | 1 | 1 |
| 215 | 1 | 1 | 7 | 1 | 1 | 1 | 1 | 1 | 1 | 1 | 1 | 1 | 1 | 1 | 1 | 1 |
| 216 | 1 | 1 | 3 | 1 | 1 | 1 | 1 | 1 | 1 | 1 | 1 | 1 | 1 | 1 | 1 | 1 |
| 217 | 1 | 3 | 1 | 1 | 1 | 1 | 1 | 1 | 1 | 1 | 1 | 1 | 1 | 1 | 1 | 1 |
| 218 | 1 | 1 | 1 | 7 | 1 | 1 | 1 | 1 | 1 | 1 | 1 | 1 | 1 | 1 | 1 | 1 |
| 219 | 1 | 1 | 1 | 1 | 1 | 1 | 1 | 1 | 1 | 1 | 1 | 1 | 1 | 1 | 1 | 1 |
| 220 | 1 | 1 | 1 | 1 | 1 | 1 | 1 | 1 | 1 | 1 | 1 | 1 | 1 | 1 | 1 | 1 |
| 221 | 1 | 1 | 1 | 1 | 7 | 1 | 1 | 1 | 1 | 1 | 1 | 1 | 1 | 1 | 1 | 1 |
| 222 | 1 | 1 | 1 | 1 | 1 | 1 | 1 | 1 | 1 | 1 | 1 | 1 | 1 | 1 | 1 | 1 |

-continued

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 223 | | | | 3 | | | | | | | | | | | | |
| 224 | | | | | | 7 | | | | | | | | | | |
| 225 | | | | | 1 | 1 | | | | | | | | | | |
| 226 | | | | | 4 | | | | | | | | | | | |
| 227 | | | | | | | 7 | | | | | | | | | |
| 228 | | | | | | 1 | 2 | | | | | | | | | |
| 229 | 3 | | | | | 3 | | | | | | | | | | |
| 230 | 4 | | | | | | | 7 | | | | | | | | |
| 231 | | | 3 | | | | | 3 | | | | | | | | |
| 232 | | 3 | 4 | | | | | | | | | | | | | |
| 233 | | 0 | | | | | | | 7 | | | | | | | |
| 234 | | 0 | | | | | | | 2 | | | | | | | |
| 235 | | 4 | | | | | 2 | | | | | | | | | |
| 236 | | | | | | | 0 | | | 7 | | | | | | |
| 237 | | | | | | | 0 | | | 1 | | | | | | |
| 238 | | | | 3 | | | 3 | | | | | | | | | |
| 239 | | | | 4 | | | | | | | 7 | | | | | |
| 240 | | | | | | | | | | 1 | 3 | | | | | |
| 241 | | | | | | | | | 2 | 3 | | | | | | |
| 242 | | | | | | | | | 0 | | | 7 | | | | |
| 243 | | | | | | | | | 0 | | | 3 | | | | |
| 244 | | | | | | 3 | | | 1 | | | | | | | |
| 245 | | | | | | 4 | | | | | | | 7 | | | |
| 246 | | | | | | | | 3 | | | | | 1 | | | |
| 247 | | | | | | | | 1 | 1 | | | | | | | |
| 248 | | | | | | | | | 4 | | | | | 7 | | |
| 249 | | | | | | | | | | | | | 1 | 3 | | |
| 250 | | | | | | | | 1 | | | | | 4 | | | |
| 251 | | | | | | | | 0 | | | | | | | 7 | |
| 252 | | | | | | | | 0 | | | | | | | 3 | |
| 253 | | | | | | | 3 | 2 | | | | | | | | |
| 254 | | | | | | | 4 | | | | | | | | | 7 |
| 255 | | | | | | | | | | | 3 | | | | | 2 |
| 256 | | | | | | | | | | 3 | 4 | | | | | |
| 257 | | | | | 4 | | | | | 4 | | | | | | |
| 258 | | | | | 0 | | | | | | | 3 | | | | |
| 259 | | | | | 0 | | | | | | | 4 | | | | |
| 260 | | | | | 3 | | | 2 | | | | | | | | |
| 261 | 4 | | | | | | | 4 | | | | | | | | |
| 262 | 2 | | | | | | | | | | | | | | | 2 |
| 263 | | | 4 | | | | | | | | | | | | | 3 |
| 264 | | | 0 | | | | | | | | | | | 3 | | |
| 265 | | | 0 | | | | | | | | | | | 1 | | |
| 266 | | 4 | 2 | | | | | | | | | | | | | |
| 267 | | 2 | | | | | | | | | | | | | 3 | |
| 268 | | | | | | | | | | | | | | 1 | 4 | |
| 269 | 2 | | | | | | | | | | | | | 4 | | |
| 270 | 0 | | | 4 | | | | | | | | | | | | |
| 271 | 0 | | | 0 | | | | | | | | | | | | |
| 272 | 7 | | | 0 | | | | | | | | | | | | |
| 273 | | | 2 | 2 | | | | | | | | | | | | |
| 274 | | 2 | 1 | | | | | | | | | | | | | |
| 275 | | 7 | | | 3 | | | | | | | | | | | |
| 276 | | | | | 2 | 4 | | | | | | | | | | |
| 277 | | | 1 | | | 2 | | | | | | | | | | |
| 278 | | | 7 | | | | | | | | | | | | | 3 |
| 279 | | | | | | | | | 4 | | | | | | | 1 |
| 280 | | | | 2 | | | | | 3 | | | | | | | |
| 281 | | | | 7 | | | | | | | | | 4 | | | |
| 282 | | | | | | | | | | | | | 3 | | | 1 |
| 283 | | | | | 2 | | | | | | | | | | | 4 |
| 284 | | | | | 7 | 2 | | | | | | | | | | |
| 285 | | | | | | 0 | 4 | | | | | | | | | |
| 286 | | | | | | 0 | 1 | | | | | | | | | |
| 287 | | | | | | 7 | | | | | 4 | | | | | |
| 288 | | | | | | | | | | 4 | 1 | | | | | |
| 289 | | | | | | | 1 | | | 2 | | | | | | |
| 290 | | | | | | | 7 | | | | | 4 | | | | |
| 291 | | | | | | | | | | | 1 | 1 | | | | |
| 292 | | | | | | | | 4 | | | 0 | | | | | |
| 293 | | | | | | | | 7 | | | 0 | | | | | |
| 294 | | | | | | | | | | | 2 | 1 | | | | |
| 295 | | | | | | | | | 3 | | | 2 | | | | |
| 296 | | | | | | | | | 7 | 2 | | | | | | |

-continued

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 297 | 1 | 1 | 1 | 1 | 1 | 1 | 1 | 1 | 1 | 0 | 1 | 1 | 3 | 1 | 1 | 1 |
| 298 | 1 | 1 | 1 | 1 | 1 | 1 | 1 | 1 | 1 | 0 | 1 | 1 | 2 | 1 | 1 | 1 |
| 299 | 1 | 1 | 1 | 1 | 1 | 1 | 1 | 1 | 1 | 7 | 1 | 1 | 1 | 1 | 4 | 1 |
| 300 | 1 | 1 | 1 | 1 | 1 | 1 | 1 | 1 | 1 | 1 | 1 | 1 | 1 | 4 | 1 | 1 |
| 301 | 1 | 1 | 1 | 1 | 1 | 1 | 1 | 1 | 1 | 1 | 2 | 1 | 1 | 2 | 1 | 1 |
| 302 | 1 | 1 | 1 | 1 | 1 | 1 | 1 | 1 | 1 | 1 | 7 | 2 | 1 | 1 | 1 | 1 |
| 303 | 1 | 1 | 1 | 1 | 1 | 1 | 1 | 1 | 1 | 1 | 1 | 0 | 1 | 1 | 1 | 1 |
| 304 | 1 | 1 | 1 | 1 | 1 | 1 | 1 | 1 | 1 | 1 | 1 | 0 | 1 | 1 | 2 | 1 |
| 305 | 1 | 1 | 1 | 1 | 1 | 1 | 1 | 1 | 1 | 1 | 1 | 7 | 2 | 1 | 1 | 1 |
| 306 | 1 | 1 | 1 | 1 | 1 | 1 | 1 | 1 | 1 | 1 | 1 | 1 | 0 | 1 | 1 | 1 |
| 307 | 1 | 1 | 1 | 1 | 1 | 1 | 1 | 1 | 1 | 1 | 1 | 1 | 0 | 1 | 1 | 1 |
| 308 | 1 | 1 | 1 | 1 | 1 | 1 | 1 | 1 | 1 | 1 | 1 | 1 | 7 | 2 | 1 | 1 |
| 309 | 1 | 1 | 1 | 1 | 1 | 1 | 1 | 1 | 1 | 1 | 1 | 1 | 1 | 0 | 1 | 1 |
| 310 | 1 | 1 | 1 | 1 | 1 | 1 | 1 | 1 | 1 | 1 | 1 | 1 | 1 | 0 | 1 | 1 |
| 311 | 1 | 1 | 1 | 1 | 1 | 1 | 1 | 1 | 1 | 1 | 1 | 1 | 1 | 7 | 2 | 1 |
| 312 | 1 | 1 | 1 | 1 | 1 | 1 | 1 | 1 | 1 | 1 | 1 | 1 | 1 | 1 | 0 | 1 |
| 313 | 1 | 1 | 1 | 1 | 1 | 1 | 1 | 1 | 1 | 1 | 1 | 1 | 1 | 1 | 0 | 1 |
| 314 | 1 | 1 | 1 | 1 | 1 | 1 | 1 | 1 | 1 | 1 | 1 | 1 | 1 | 1 | 7 | 4 |
| 315 | 1 | 1 | 1 | 1 | 1 | 1 | 1 | 1 | 1 | 1 | 1 | 1 | 1 | 1 | 1 | 0 |
| 316 | 1 | 1 | 1 | 1 | 1 | 1 | 1 | 1 | 1 | 1 | 1 | 1 | 1 | 1 | 1 | 0 |
| 317 | 1 | 1 | 1 | 1 | 1 | 1 | 1 | 1 | 1 | 1 | 1 | 1 | 1 | 1 | 1 | 7 |
| 318 | 7 | 1 | 1 | 1 | 1 | 1 | 1 | 1 | 1 | 1 | 1 | 1 | 1 | 1 | 1 | 1 |
| 319 | 6 | 7 | 1 | 1 | 1 | 1 | 1 | 1 | 1 | 1 | 1 | 1 | 1 | 1 | 1 | 1 |
| 320 | 1 | 6 | 7 | 1 | 1 | 1 | 1 | 1 | 1 | 1 | 1 | 1 | 1 | 1 | 1 | 1 |
| 321 | 1 | 1 | 6 | 7 | 1 | 1 | 1 | 1 | 1 | 1 | 1 | 1 | 1 | 1 | 1 | 1 |
| 322 | 1 | 1 | 1 | 6 | 7 | 1 | 1 | 1 | 1 | 1 | 1 | 1 | 1 | 1 | 1 | 1 |
| 323 | 1 | 1 | 1 | 1 | 6 | 7 | 1 | 1 | 1 | 1 | 1 | 1 | 1 | 1 | 1 | 1 |
| 324 | 1 | 1 | 1 | 1 | 1 | 6 | 7 | 1 | 1 | 1 | 1 | 1 | 1 | 1 | 1 | 1 |
| 325 | 1 | 1 | 1 | 1 | 1 | 1 | 6 | 7 | 1 | 1 | 1 | 1 | 1 | 1 | 1 | 1 |
| 326 | 1 | 1 | 1 | 1 | 1 | 1 | 1 | 6 | 7 | 1 | 1 | 1 | 1 | 1 | 1 | 1 |
| 327 | 1 | 1 | 1 | 1 | 1 | 1 | 1 | 1 | 6 | 7 | 1 | 1 | 1 | 1 | 1 | 1 |
| 328 | 1 | 1 | 1 | 1 | 1 | 1 | 1 | 1 | 1 | 6 | 7 | 1 | 1 | 1 | 1 | 1 |
| 329 | 1 | 1 | 1 | 1 | 1 | 1 | 1 | 1 | 1 | 1 | 6 | 7 | 1 | 1 | 1 | 1 |
| 330 | 1 | 1 | 1 | 1 | 1 | 1 | 1 | 1 | 1 | 1 | 1 | 6 | 7 | 1 | 1 | 1 |
| 331 | 1 | 1 | 1 | 1 | 1 | 1 | 1 | 1 | 1 | 1 | 1 | 1 | 6 | 7 | 1 | 1 |
| 332 | 1 | 1 | 1 | 1 | 1 | 1 | 1 | 1 | 1 | 1 | 1 | 1 | 1 | 6 | 7 | 1 |
| 333 | 1 | 1 | 1 | 1 | 1 | 1 | 1 | 1 | 1 | 1 | 1 | 1 | 1 | 1 | 6 | 7 |
| 334 | 6 | 1 | 1 | 1 | 1 | 1 | 1 | 1 | 1 | 1 | 1 | 1 | 1 | 1 | 1 | 6 |
| 335 | 7 | 6 | 1 | 1 | 1 | 1 | 1 | 1 | 1 | 1 | 1 | 1 | 1 | 1 | 1 | 1 |
| 336 | 1 | 7 | 6 | 1 | 1 | 1 | 1 | 1 | 1 | 1 | 1 | 1 | 1 | 1 | 1 | 1 |
| 337 | 1 | 1 | 7 | 6 | 1 | 1 | 1 | 1 | 1 | 1 | 1 | 1 | 1 | 1 | 1 | 1 |
| 338 | 1 | 1 | 1 | 7 | 6 | 1 | 1 | 1 | 1 | 1 | 1 | 1 | 1 | 1 | 1 | 1 |
| 339 | 1 | 1 | 1 | 1 | 7 | 6 | 1 | 1 | 1 | 1 | 1 | 1 | 1 | 1 | 1 | 1 |
| 340 | 1 | 1 | 1 | 1 | 1 | 7 | 6 | 1 | 1 | 1 | 1 | 1 | 1 | 1 | 1 | 1 |
| 341 | 1 | 1 | 1 | 1 | 1 | 1 | 7 | 6 | 1 | 1 | 1 | 1 | 1 | 1 | 1 | 1 |
| 342 | 1 | 1 | 1 | 1 | 1 | 1 | 1 | 7 | 6 | 1 | 1 | 1 | 1 | 1 | 1 | 1 |
| 343 | 1 | 1 | 1 | 1 | 1 | 1 | 1 | 1 | 7 | 6 | 1 | 1 | 1 | 1 | 1 | 1 |
| 344 | 1 | 1 | 1 | 1 | 1 | 1 | 1 | 1 | 1 | 7 | 6 | 1 | 1 | 1 | 1 | 1 |
| 345 | 1 | 1 | 1 | 1 | 1 | 1 | 1 | 1 | 1 | 1 | 7 | 6 | 1 | 1 | 1 | 1 |
| 346 | 1 | 1 | 1 | 1 | 1 | 1 | 1 | 1 | 1 | 1 | 1 | 7 | 6 | 1 | 1 | 1 |
| 347 | 1 | 1 | 1 | 1 | 1 | 1 | 1 | 1 | 1 | 1 | 1 | 1 | 7 | 6 | 1 | 1 |
| 348 | 1 | 1 | 1 | 1 | 1 | 1 | 1 | 1 | 1 | 1 | 1 | 1 | 1 | 7 | 6 | 1 |
| 349 | 1 | 1 | 1 | 1 | 1 | 1 | 1 | 1 | 1 | 1 | 1 | 1 | 1 | 1 | 7 | 6 |
| 350 | 7 | 1 | 1 | 1 | 1 | 1 | 1 | 1 | 1 | 1 | 1 | 1 | 1 | 1 | 1 | 7 |
| 351 | 5 | 7 | 1 | 1 | 1 | 1 | 1 | 1 | 1 | 1 | 1 | 1 | 1 | 1 | 1 | 1 |
| 352 | 1 | 5 | 7 | 1 | 1 | 1 | 1 | 1 | 1 | 1 | 1 | 1 | 1 | 1 | 1 | 1 |
| 353 | 1 | 1 | 5 | 7 | 1 | 1 | 1 | 1 | 1 | 1 | 1 | 1 | 1 | 1 | 1 | 1 |
| 354 | 1 | 1 | 1 | 5 | 7 | 1 | 1 | 1 | 1 | 1 | 1 | 1 | 1 | 1 | 1 | 1 |
| 355 | 1 | 1 | 1 | 1 | 5 | 7 | 1 | 1 | 1 | 1 | 1 | 1 | 1 | 1 | 1 | 1 |
| 356 | 1 | 1 | 1 | 1 | 1 | 5 | 7 | 1 | 1 | 1 | 1 | 1 | 1 | 1 | 1 | 1 |
| 357 | 1 | 1 | 1 | 1 | 1 | 1 | 5 | 7 | 1 | 1 | 1 | 1 | 1 | 1 | 1 | 1 |
| 358 | 1 | 1 | 1 | 1 | 1 | 1 | 1 | 5 | 7 | 1 | 1 | 1 | 1 | 1 | 1 | 1 |
| 359 | 1 | 1 | 1 | 1 | 1 | 1 | 1 | 1 | 5 | 7 | 1 | 1 | 1 | 1 | 1 | 1 |
| 360 | 1 | 1 | 1 | 1 | 1 | 1 | 1 | 1 | 1 | 5 | 7 | 1 | 1 | 1 | 1 | 1 |
| 361 | 1 | 1 | 1 | 1 | 1 | 1 | 1 | 1 | 1 | 1 | 5 | 7 | 1 | 1 | 1 | 1 |
| 362 | 1 | 1 | 1 | 1 | 1 | 1 | 1 | 1 | 1 | 1 | 1 | 5 | 7 | 1 | 1 | 1 |
| 363 | 1 | 1 | 1 | 1 | 1 | 1 | 1 | 1 | 1 | 1 | 1 | 1 | 5 | 7 | 1 | 1 |
| 364 | 1 | 1 | 1 | 1 | 1 | 1 | 1 | 1 | 1 | 1 | 1 | 1 | 1 | 5 | 7 | 1 |
| 365 | 1 | 1 | 1 | 1 | 1 | 1 | 1 | 1 | 1 | 1 | 1 | 1 | 1 | 1 | 5 | 7 |
| 366 | 5 | 1 | 1 | 1 | 1 | 1 | 1 | 1 | 1 | 1 | 1 | 1 | 1 | 1 | 1 | 5 |
| 367 | 7 | 5 | 1 | 1 | 1 | 1 | 1 | 1 | 1 | 1 | 1 | 1 | 1 | 1 | 1 | 1 |
| 368 | 1 | 7 | 5 | 1 | 1 | 1 | 1 | 1 | 1 | 1 | 1 | 1 | 1 | 1 | 1 | 1 |
| 369 | 1 | 1 | 7 | 5 | 1 | 1 | 1 | 1 | 1 | 1 | 1 | 1 | 1 | 1 | 1 | 1 |
| 370 | 1 | 1 | 1 | 7 | 5 | 1 | 1 | 1 | 1 | 1 | 1 | 1 | 1 | 1 | 1 | 1 |

-continued

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 371 | | | | | 7 | 5 | | | | | | | | | | |
| 372 | | | | | | 7 | 5 | | | | | | | | | |
| 373 | | | | | | | 7 | 5 | | | | | | | | |
| 374 | | | | | | | | 7 | 5 | | | | | | | |
| 375 | | | | | | | | | 7 | 5 | | | | | | |
| 376 | | | | | | | | | | 7 | 5 | | | | | |
| 377 | | | | | | | | | | | 7 | 5 | | | | |
| 378 | | | | | | | | | | | | 7 | 5 | | | |
| 379 | | | | | | | | | | | | | 7 | 5 | | |
| 380 | | | | | | | | | | | | | | 7 | 5 | |
| 381 | | | | | | | | | | | | | | | 7 | 5 |
| 382 | 7 | | | | | | | | | | | | | | | 7 |
| 383 | 6 | 7 | | | | | | | | | | | | | | |
| 384 | | 6 | 7 | | | | | | | | | | | | | |
| 385 | | | 6 | 7 | | | | | | | | | | | | |
| 386 | | | | 6 | 7 | | | | | | | | | | | |
| 387 | | | | | 6 | 7 | | | | | | | | | | |
| 388 | | | | | | 6 | 7 | | | | | | | | | |
| 389 | | | | | | | 6 | 7 | | | | | | | | |
| 390 | | | | | | | | 6 | 7 | | | | | | | |
| 391 | | | | | | | | | 6 | 7 | | | | | | |
| 392 | | | | | | | | | | 6 | 7 | | | | | |
| 393 | | | | | | | | | | | 6 | 7 | | | | |
| 394 | | | | | | | | | | | | 6 | 7 | | | |
| 395 | | | | | | | | | | | | | 6 | 7 | | |
| 396 | | | | | | | | | | | | | | 6 | 7 | |
| 397 | | | | | | | | | | | | | | | 6 | 7 |
| 398 | 6 | | | | | | | | | | | | | | | 6 |
| 399 | 7 | 6 | | | | | | | | | | | | | | |
| 400 | | 7 | 6 | | | | | | | | | | | | | |
| 401 | | | 7 | 6 | | | | | | | | | | | | |
| 402 | | | | 7 | 6 | | | | | | | | | | | |
| 403 | | | | | 7 | 6 | | | | | | | | | | |
| 404 | | | | | | 7 | 6 | | | | | | | | | |
| 405 | | | | | | | 7 | 6 | | | | | | | | |
| 406 | | | | | | | | 7 | 6 | | | | | | | |
| 407 | | | | | | | | | 7 | 6 | | | | | | |
| 408 | | | | | | | | | | 7 | 6 | | | | | |
| 409 | | | | | | | | | | | 7 | 6 | | | | |
| 410 | | | | | | | | | | | | 7 | 6 | | | |
| 411 | | | | | | | | | | | | | 7 | 6 | | |
| 412 | | | | | | | | | | | | | | 7 | 6 | |
| 413 | | | | | | | | | | | | | | | 7 | 6 |
| 414 | 7 | | | | | | | | | | | | | | | 7 |
| 415 | 6 | 7 | | | | | | | | | | | | | | |
| 416 | | 6 | 7 | | | | | | | | | | | | | |
| 417 | | | 6 | 7 | | | | | | | | | | | | |
| 418 | | | | 6 | 7 | | | | | | | | | | | |
| 419 | | | | | 6 | 7 | | | | | | | | | | |
| 420 | | | | | | 6 | 7 | | | | | | | | | |
| 421 | | | | | | | 6 | 7 | | | | | | | | |
| 422 | | | | | | | | 6 | 7 | | | | | | | |
| 423 | | | | | | | | | 6 | 7 | | | | | | |
| 424 | | | | | | | | | | 6 | 7 | | | | | |
| 425 | | | | | | | | | | | 6 | 7 | | | | |
| 426 | | | | | | | | | | | | 6 | 7 | | | |
| 427 | | | | | | | | | | | | | 6 | 7 | | |
| 428 | | | | | | | | | | | | | | 6 | 7 | |
| 429 | | | | | | | | | | | | | | | 6 | 7 |
| 430 | 6 | | | | | | | | | | | | | | | 6 |
| 431 | 7 | 6 | | | | | | | | | | | | | | |
| 432 | | 7 | 6 | | | | | | | | | | | | | |
| 433 | | | 7 | 6 | | | | | | | | | | | | |
| 434 | | | | 7 | 6 | | | | | | | | | | | |
| 435 | | | | | 7 | 6 | | | | | | | | | | |
| 436 | | | | | | 7 | 6 | | | | | | | | | |
| 437 | | | | | | | 7 | 6 | | | | | | | | |
| 438 | | | | | | | | 7 | 6 | | | | | | | |
| 439 | | | | | | | | | 7 | 6 | | | | | | |
| 440 | | | | | | | | | | 7 | 6 | | | | | |
| 441 | | | | | | | | | | | 7 | 6 | | | | |
| 442 | | | | | | | | | | | | 7 | 6 | | | |
| 443 | | | | | | | | | | | | | 7 | 6 | | |
| 444 | | | | | | | | | | | | | | 7 | 6 | |

-continued

APPENDIX A

| Time Slice number | Reset-group number: 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 445 | 1 | 1 | 1 | 1 | 1 | 1 | 1 | 1 | 1 | 1 | 1 | 1 | 1 | 1 | 7 | 6 |
| 446 | 7 | 1 | 1 | 1 | 1 | 1 | 1 | 1 | 1 | 1 | 1 | 1 | 1 | 1 | 1 | 7 |
| 447 | 5 | 7 | 1 | 1 | 1 | 1 | 1 | 1 | 1 | 1 | 1 | 1 | 1 | 1 | 1 | 1 |
| 448 | 1 | 5 | 7 | 1 | 1 | 1 | 1 | 1 | 1 | 1 | 1 | 1 | 1 | 1 | 1 | 1 |
| 449 | 1 | 1 | 5 | 7 | 1 | 1 | 1 | 1 | 1 | 1 | 1 | 1 | 1 | 1 | 1 | 1 |
| 450 | 1 | 1 | 1 | 5 | 7 | 1 | 1 | 1 | 1 | 1 | 1 | 1 | 1 | 1 | 1 | 1 |
| 451 | 1 | 1 | 1 | 1 | 5 | 7 | 1 | 1 | 1 | 1 | 1 | 1 | 1 | 1 | 1 | 1 |
| 452 | 1 | 1 | 1 | 1 | 1 | 5 | 7 | 1 | 1 | 1 | 1 | 1 | 1 | 1 | 1 | 1 |
| 453 | 1 | 1 | 1 | 1 | 1 | 1 | 5 | 7 | 1 | 1 | 1 | 1 | 1 | 1 | 1 | 1 |
| 454 | 1 | 1 | 1 | 1 | 1 | 1 | 1 | 5 | 7 | 1 | 1 | 1 | 1 | 1 | 1 | 1 |
| 455 | 1 | 1 | 1 | 1 | 1 | 1 | 1 | 1 | 5 | 7 | 1 | 1 | 1 | 1 | 1 | 1 |
| 456 | 1 | 1 | 1 | 1 | 1 | 1 | 1 | 1 | 1 | 5 | 7 | 1 | 1 | 1 | 1 | 1 |
| 457 | 1 | 1 | 1 | 1 | 1 | 1 | 1 | 1 | 1 | 1 | 5 | 7 | 1 | 1 | 1 | 1 |
| 458 | 1 | 1 | 1 | 1 | 1 | 1 | 1 | 1 | 1 | 1 | 1 | 5 | 7 | 1 | 1 | 1 |
| 459 | 1 | 1 | 1 | 1 | 1 | 1 | 1 | 1 | 1 | 1 | 1 | 1 | 5 | 7 | 1 | 1 |
| 460 | 1 | 1 | 1 | 1 | 1 | 1 | 1 | 1 | 1 | 1 | 1 | 1 | 1 | 5 | 7 | 1 |
| 461 | 1 | 1 | 1 | 1 | 1 | 1 | 1 | 1 | 1 | 1 | 1 | 1 | 1 | 1 | 5 | 7 |
| 462 | 5 | 1 | 1 | 1 | 1 | 1 | 1 | 1 | 1 | 1 | 1 | 1 | 1 | 1 | 1 | 5 |
| 463 | 7 | 5 | 1 | 1 | 1 | 1 | 1 | 1 | 1 | 1 | 1 | 1 | 1 | 1 | 1 | 1 |
| 464 | 1 | 7 | 5 | 1 | 1 | 1 | 1 | 1 | 1 | 1 | 1 | 1 | 1 | 1 | 1 | 1 |
| 465 | 1 | 1 | 7 | 5 | 1 | 1 | 1 | 1 | 1 | 1 | 1 | 1 | 1 | 1 | 1 | 1 |
| 466 | 1 | 1 | 1 | 7 | 5 | 1 | 1 | 1 | 1 | 1 | 1 | 1 | 1 | 1 | 1 | 1 |
| 467 | 1 | 1 | 1 | 1 | 7 | 5 | 1 | 1 | 1 | 1 | 1 | 1 | 1 | 1 | 1 | 1 |
| 468 | 1 | 1 | 1 | 1 | 1 | 7 | 5 | 1 | 1 | 1 | 1 | 1 | 1 | 1 | 1 | 1 |
| 469 | 1 | 1 | 1 | 1 | 1 | 1 | 7 | 5 | 1 | 1 | 1 | 1 | 1 | 1 | 1 | 1 |
| 470 | 1 | 1 | 1 | 1 | 1 | 1 | 1 | 7 | 5 | 1 | 1 | 1 | 1 | 1 | 1 | 1 |
| 471 | 1 | 1 | 1 | 1 | 1 | 1 | 1 | 1 | 7 | 5 | 1 | 1 | 1 | 1 | 1 | 1 |
| 472 | 1 | 1 | 1 | 1 | 1 | 1 | 1 | 1 | 1 | 7 | 5 | 1 | 1 | 1 | 1 | 1 |
| 473 | 1 | 1 | 1 | 1 | 1 | 1 | 1 | 1 | 1 | 1 | 7 | 5 | 1 | 1 | 1 | 1 |
| 474 | 1 | 1 | 1 | 1 | 1 | 1 | 1 | 1 | 1 | 1 | 1 | 7 | 5 | 1 | 1 | 1 |
| 475 | 1 | 1 | 1 | 1 | 1 | 1 | 1 | 1 | 1 | 1 | 1 | 1 | 7 | 5 | 1 | 1 |
| 476 | 1 | 1 | 1 | 1 | 1 | 1 | 1 | 1 | 1 | 1 | 1 | 1 | 1 | 7 | 5 | 1 |
| 477 | 1 | 1 | 1 | 1 | 1 | 1 | 1 | 1 | 1 | 1 | 1 | 1 | 1 | 1 | 7 | 5 |
| 478 | 7 | 1 | 1 | 1 | 1 | 1 | 1 | 1 | 1 | 1 | 1 | 1 | 1 | 1 | 1 | 7 |
| 479 | 6 | 7 | 1 | 1 | 1 | 1 | 1 | 1 | 1 | 1 | 1 | 1 | 1 | 1 | 1 | 1 |
| 480 | 1 | 6 | 7 | 1 | 1 | 1 | 1 | 1 | 1 | 1 | 1 | 1 | 1 | 1 | 1 | 1 |
| 481 | 1 | 1 | 6 | 7 | 1 | 1 | 1 | 1 | 1 | 1 | 1 | 1 | 1 | 1 | 1 | 1 |
| 482 | 1 | 1 | 1 | 6 | 7 | 1 | 1 | 1 | 1 | 1 | 1 | 1 | 1 | 1 | 1 | 1 |
| 483 | 1 | 1 | 1 | 1 | 6 | 7 | 1 | 1 | 1 | 1 | 1 | 1 | 1 | 1 | 1 | 1 |
| 484 | 1 | 1 | 1 | 1 | 1 | 6 | 7 | 1 | 1 | 1 | 1 | 1 | 1 | 1 | 1 | 1 |
| 485 | 1 | 1 | 1 | 1 | 1 | 1 | 6 | 7 | 1 | 1 | 1 | 1 | 1 | 1 | 1 | 1 |
| 486 | 1 | 1 | 1 | 1 | 1 | 1 | 1 | 6 | 7 | 1 | 1 | 1 | 1 | 1 | 1 | 1 |
| 487 | 1 | 1 | 1 | 1 | 1 | 1 | 1 | 1 | 6 | 7 | 1 | 1 | 1 | 1 | 1 | 1 |
| 488 | 1 | 1 | 1 | 1 | 1 | 1 | 1 | 1 | 1 | 6 | 7 | 1 | 1 | 1 | 1 | 1 |
| 489 | 1 | 1 | 1 | 1 | 1 | 1 | 1 | 1 | 1 | 1 | 6 | 7 | 1 | 1 | 1 | 1 |
| 490 | 1 | 1 | 1 | 1 | 1 | 1 | 1 | 1 | 1 | 1 | 1 | 6 | 7 | 1 | 1 | 1 |
| 491 | 1 | 1 | 1 | 1 | 1 | 1 | 1 | 1 | 1 | 1 | 1 | 1 | 6 | 7 | 1 | 1 |
| 492 | 1 | 1 | 1 | 1 | 1 | 1 | 1 | 1 | 1 | 1 | 1 | 1 | 1 | 6 | 7 | 1 |
| 493 | 1 | 1 | 1 | 1 | 1 | 1 | 1 | 1 | 1 | 1 | 1 | 1 | 1 | 1 | 6 | 7 |
| 494 | 6 | 1 | 1 | 1 | 1 | 1 | 1 | 1 | 1 | 1 | 1 | 1 | 1 | 1 | 1 | 6 |
| 495 | 7 | 6 | 1 | 1 | 1 | 1 | 1 | 1 | 1 | 1 | 1 | 1 | 1 | 1 | 1 | 1 |
| 496 | 1 | 7 | 6 | 1 | 1 | 1 | 1 | 1 | 1 | 1 | 1 | 1 | 1 | 1 | 1 | 1 |
| 497 | 1 | 1 | 7 | 6 | 1 | 1 | 1 | 1 | 1 | 1 | 1 | 1 | 1 | 1 | 1 | 1 |
| 498 | 1 | 1 | 1 | 7 | 6 | 1 | 1 | 1 | 1 | 1 | 1 | 1 | 1 | 1 | 1 | 1 |
| 499 | 1 | 1 | 1 | 1 | 7 | 6 | 1 | 1 | 1 | 1 | 1 | 1 | 1 | 1 | 1 | 1 |
| 500 | 1 | 1 | 1 | 1 | 1 | 7 | 6 | 1 | 1 | 1 | 1 | 1 | 1 | 1 | 1 | 1 |
| 501 | 1 | 1 | 1 | 1 | 1 | 1 | 7 | 6 | 1 | 1 | 1 | 1 | 1 | 1 | 1 | 1 |
| 502 | 1 | 1 | 1 | 1 | 1 | 1 | 1 | 7 | 6 | 1 | 1 | 1 | 1 | 1 | 1 | 1 |
| 503 | 1 | 1 | 1 | 1 | 1 | 1 | 1 | 1 | 7 | 6 | 1 | 1 | 1 | 1 | 1 | 1 |
| 504 | 1 | 1 | 1 | 1 | 1 | 1 | 1 | 1 | 1 | 7 | 6 | 1 | 1 | 1 | 1 | 1 |
| 505 | 1 | 1 | 1 | 1 | 1 | 1 | 1 | 1 | 1 | 1 | 7 | 6 | 1 | 1 | 1 | 1 |
| 506 | 1 | 1 | 1 | 1 | 1 | 1 | 1 | 1 | 1 | 1 | 1 | 7 | 6 | 1 | 1 | 1 |
| 507 | 1 | 1 | 1 | 1 | 1 | 1 | 1 | 1 | 1 | 1 | 1 | 1 | 7 | 6 | 1 | 1 |
| 508 | 1 | 1 | 1 | 1 | 1 | 1 | 1 | 1 | 1 | 1 | 1 | 1 | 1 | 7 | 6 | 1 |
| 509 | 1 | 1 | 1 | 1 | 1 | 1 | 1 | 1 | 1 | 1 | 1 | 1 | 1 | 1 | 7 | 6 |
| 510 | 7 | 1 | 1 | 1 | 1 | 1 | 1 | 1 | 1 | 1 | 1 | 1 | 1 | 1 | 1 | 7 |
| 511 | | 7 | 1 | 1 | 1 | 1 | 1 | 1 | 1 | 1 | 1 | 1 | 1 | 1 | 1 | 1 |
| 512 | | | 7 | 1 | 1 | 1 | 1 | 1 | 1 | 1 | 1 | 1 | 1 | 1 | 1 | 1 |
| 513 | | | | 7 | 1 | 1 | 1 | 1 | 1 | 1 | 1 | 1 | 1 | 1 | 1 | 1 |
| 514 | | | | | 7 | 1 | 1 | 1 | 1 | 1 | 1 | 1 | 1 | 1 | 1 | 1 |
| 515 | | | | | | 7 | 1 | 1 | 1 | 1 | 1 | 1 | 1 | 1 | 1 | 1 |
| 516 | | | | | | | 7 | 1 | 1 | 1 | 1 | 1 | 1 | 1 | 1 | 1 |
| 517 | | | | | | | | 7 | 1 | 1 | 1 | 1 | 1 | 1 | 1 | 1 |
| 518 | | | | | | | | | 7 | 1 | 1 | 1 | 1 | 1 | 1 | 1 |

-continued

APPENDIX A

| Time Slice | Reset-group number: | | | | | | | | | | | | | | | |
|---|---|---|---|---|---|---|---|---|---|---|---|---|---|---|---|---|
| number | 1 | 2 | 3 | 4 | 5 | 6 | 7 | 8 | 9 | 10 | 11 | 12 | 13 | 14 | 15 | 16 |
| 519 | | | | | | | | | | 7 | \| | \| | \| | \| | \| | \| |
| 520 | | | | | | | | | | | 7 | \| | \| | \| | \| | \| |
| 521 | | | | | | | | | | | | 7 | \| | \| | \| | \| |
| 522 | | | | | | | | | | | | | 7 | \| | \| | \| |
| 523 | | | | | | | | | | | | | | 7 | \| | \| |
| 524 | | | | | | | | | | | | | | | 7 | \| |
| 525 | | | | | | | | | | | | | | | | 7 |

What is claimed is:

1. A method of loading frames of data to a spatial light modulator having individually addressable pixel elements, for a pulse width modulated display, comprising the steps of:

dividing the display period for each said frame of data into a number of time slices;

formatting each frame of data into bit-planes, each bit-plane having one bit of data for each of said pixel elements, and each bit-plane representing a bit-weight of the intensity value to be displayed by that pixel element, and each bit-plane having a display time corresponding to a number of said time slices;

sub-formatting said bit-planes into reset groups, each reset group having data for a group of pixel elements to be loaded at a different time from other pixel elements, wherein said reset groups are defined by one memory cell providing data to more than one pixel element;

segmenting into segments, the display times of reset groups of bit-planes of one or more of the more significant bit weights;

front-frame loading said segments at the beginning of said frame period, such that, for all reset groups, segments having the same bit weight are loaded at substantially the same time;

mid-frame loading the reset groups of bit-planes of one or more of the less significant bits at the middle of said frame period; and end-frame loading the remaining of said segments at the end of said frame period, such that for all reset groups, segments having the same bit-weight are loaded at substantially the same time.

2. The method of claim 1, wherein said front-frame and said end-frame loading steps are performed by separating the loading for each said reset group by one of said time slices.

3. The method of claim 1, wherein each of said time slices has a duration of the display time of the least significant bit of said intensity values.

4. The method of claim 1, wherein each of said time slices has a duration of twice the display time of the least significant bit of said intensity values.

5. The method of claim 1 wherein said segmenting step is performed such that the number of segments is the number of said time slices less the number of loads of said bit-planes of said less significant bits.

6. The method of claim 1, wherein said front-frame loading step is performed by using one of said segments as a buffer segment, which varies in size among reset groups so as to permit substantial alignment during said mid-frame loading.

7. The method of claim 1, wherein all segments of the same bit-plane have the same number of time slices.

8. The method of claim 1, wherein all segments of the same reset groups have the same number of time slices.

9. The method of claim 1, wherein said front-frame loading and said end-frame loading are the same sequence for all of said reset groups.

10. The method of claim 1, wherein said mid-frame loading is performed in a different sequence for different of said reset groups.

11. The method of claim 1, wherein said more significant bits are bit greater than bit 2.

12. The method of claim 11, wherein said front-frame loading step is performed by using one of said segments as a buffer segment, which varies in size among reset groups so as to permit substantial alignment of bit 3.

13. The method of claim 1, wherein said front-frame loading, mid-frame loading, and end-frame loading are sequenced in n series of every nth reset group.

* * * * *